US006619499B1

(12) United States Patent
Lin

(10) Patent No.: US 6,619,499 B1
(45) Date of Patent: Sep. 16, 2003

(54) VENTED LID ASSEMBLY FOR A SANITARY CONTAINER

(76) Inventor: Peter Lin, 345 Ivyland Rd., Warminster, PA (US) 18974

( * ) Notice: Subject to any disclaimer, the term of this patent is extended or adjusted under 35 U.S.C. 154(b) by 217 days.

(21) Appl. No.: 09/656,392

(22) Filed: Sep. 6, 2000

(51) Int. Cl.[7] ..... B65D 51/16

(52) U.S. Cl. ..... 220/371; 215/308; 215/902; 220/256.1

(58) Field of Search ..... 220/371, 367.1, 220/370, 373, 521, 522, 253, 254.8, 255, 256.1, 259.3, 259.4, 372; 215/307, 902, 308

(56) References Cited

U.S. PATENT DOCUMENTS 3,578,201 A * 5/1971 Smith, Jr. ..... 137/43
4,271,973 A * 6/1981 Quagliaro et al. ..... 215/261
5,066,597 A * 11/1991 Stinson et al. ..... 206/439
5,353,949 A * 10/1994 Seibert et al. ..... 220/304
5,395,006 A * 3/1995 Verma ..... 215/261
5,727,707 A * 3/1998 Wickland et al. ..... 220/288
6,170,684 B1 * 1/2001 Vincent et al. ..... 215/248
6,274,209 B1 * 8/2001 Pagidas et al. ..... 206/204

* cited by examiner

*Primary Examiner*—Lee Young
*Assistant Examiner*—Niki M. Eloshway
(74) *Attorney, Agent, or Firm*—LaMorte & Associates

(57) ABSTRACT

A venting system for a container and the overall container assembly that uses the venting system is claimed. A container and a lid are provided. The lid of the container defines a venting port for equalizing gas pressure within the container. A support platform is placed over the venting port. The support platform defines a plurality of holes. Placed in each of the holes is a filter element. The filter element is made of a porous sintered powder metal having a pore size of no greater than five microns. In this manner the filter elements enable gas to vent to and from the container, yet the contents of the container are prevented from passing through the filter elements should the contents of the container touch the filter elements.

5 Claims, 4 Drawing Sheets

VENTED LID ASSEMBLY FOR A SANITARY CONTAINER

BACKGROUND OF THE INVENTION

1. Field of the Invention

The present invention relates to lids for sanitary containers, such as those used to ship and store bulk pharmaceuticals. More particularly, the present invention relates to lid structures that contain venting ports to prevent the lids from becoming vapor locked on the container they cover.

2. Description of the Prior Art

In the manufacture and processing of pharmaceutical products, dairy products and other materials that require a sanitary processing environment, it is common for materials to be transported, stored and processed in stainless steel containers. The stainless steel containers are covered with lids that are joined to the container with a clamp. The containers, the lids and the clamps are typically made from stainless steel so that all components can be sanitized in an autoclave prior to use. In this manner, the container, lid and clamp can be kept sterile so as not to introduce harmful contamination into the pharmaceutical product being transported or stored.

When a pharmaceutical is placed in a container, the pharmaceutical is at a certain temperature and embodies a certain vapor pressure at that temperature. When the container is again opened at some later time, the temperature of the pharmaceutical may have changed. If the pharmaceutical stored in the container has cooled, its corresponding vapor pressure has also dropped within the container. Accordingly, the pressure within the container may be significantly lower than that of the surrounding ambient pressure. In such cases, the lid of the container is held in position by the pressure differential between the interior of the container and the air surrounding the container. Often, the lid pressure differential is so great that the lid of the container cannot be removed by hand. In such circumstances, the lid is said to be vapor locked. A tool, such as a screw driver, must then be used to pry the lid off of the container. This is often difficult to do without spilling or contaminating the stored pharmaceutical.

In other situations, pharmaceuticals are stored at cold temperatures or are stored in pools of liquified gas, such as liquid nitrogen. As the contents of the container increase in temperature, the vapor pressure within the container increases dramatically. In certain circumstances, the increase in pressure within the container is sufficient to dislodge the clamp around the lid or deform the container walls until the seal with the lid is breached.

An obvious solution to prevent pressure differentials within a container is to vent the container to ambient pressure. However, to vent a container is to provide an avenue for contaminants to enter the container and for pharmaceuticals to exit the container. Expensive one-way flow valves can be used to vent containers. However, the use of flow valves is impractical because such structures harbor contaminants and cannot be economically cleaned. As such, after each use, many prior art flow valve mechanisms are replaced.

A need therefore exists for a container venting system that vents a container to ambient pressure, yet prevents contamination within the container and prevents spillage from the container. The venting system must also be easily sanitized using traditional autoclaving techniques. This need is met by the present invention as it is described and claimed below.

SUMMARY OF THE INVENTION

The present invention is a venting system for a container and the overall container assembly that uses the venting system. A container and a lid are provided. The lid of the container defines a venting port for equalizing gas pressure within the container. A support platform is placed over the venting port. The support platform defines a plurality of holes. Placed in each of the holes is a filter element. The filter element is made of a porous sintered powder metal having a pore size of no greater than five microns. In this manner the filter elements enable gas to vent to and from the container, yet the contents of the container are prevented from passing through the filter elements should the contents of the container touch the filter elements.

The filter elements, support platform and container lid are all made of the same metal. In this manner, the components respond to temperature changes in the same manner. Furthermore, filter elements, support platform and container lid are capable of being sterilized together in the same industrial autoclave facility.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention assembly can be used to vent most any type of sealed container that has a lid, the present invention assembly is especially well suited for use in sealing stainless steel pharmaceutical containers that must maintain sanitary conditions internally. Accordingly, by way of example, the present invention device and system will be described as adapted for use with a stainless steel sanitary pharmaceutical container.

Figure 1:
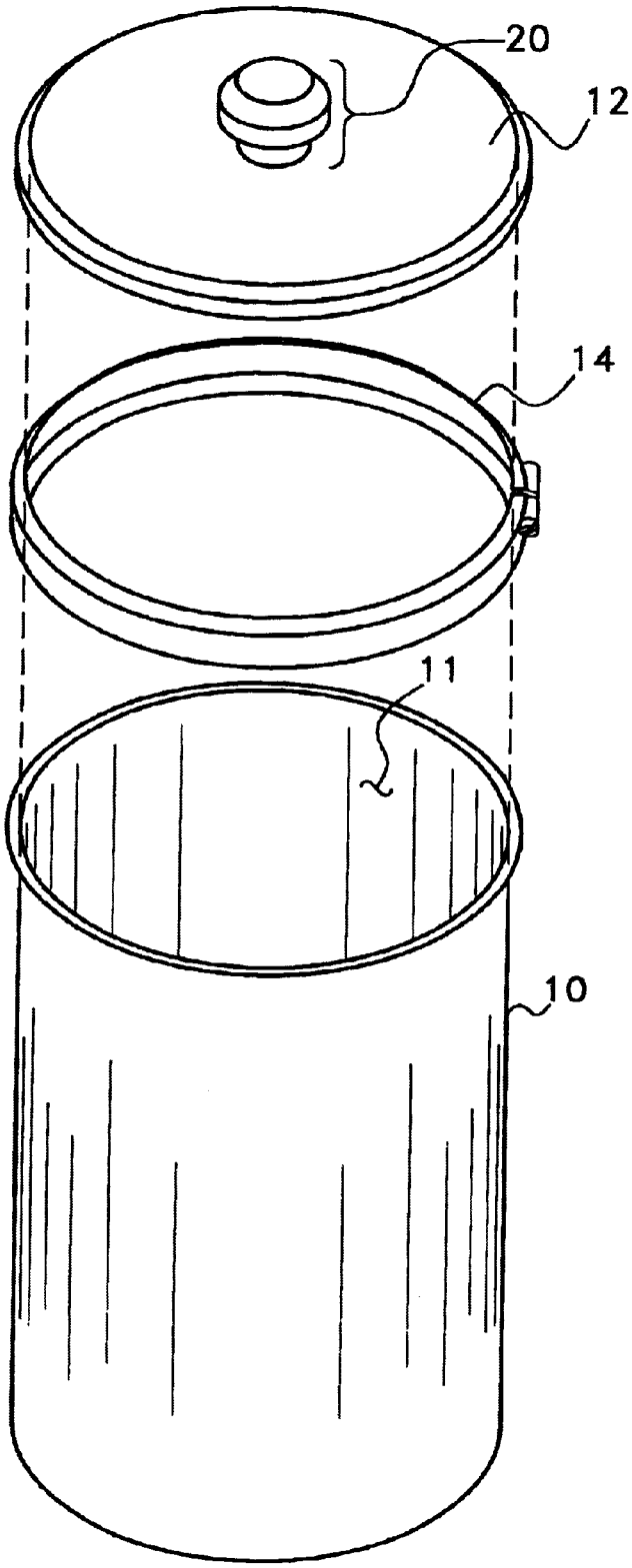
FIG. 1 is a perspective view of a container system in accordance with the present invention.

Referring to FIG. 1, there is shown a pharmaceutical container 10. The container 10 has an open top 11 that is covered by a lid 12. The lid 12 is firmly clamped to the container 10 using a clamping ring 14. In the center of the lid 12 is disposed a venting port assembly 20. The venting port assembly 20 is used to maintain ambient pressure within the sealed container 10 without permitting contamination of the container'contents or leakage from the container 10.

Figure 2:
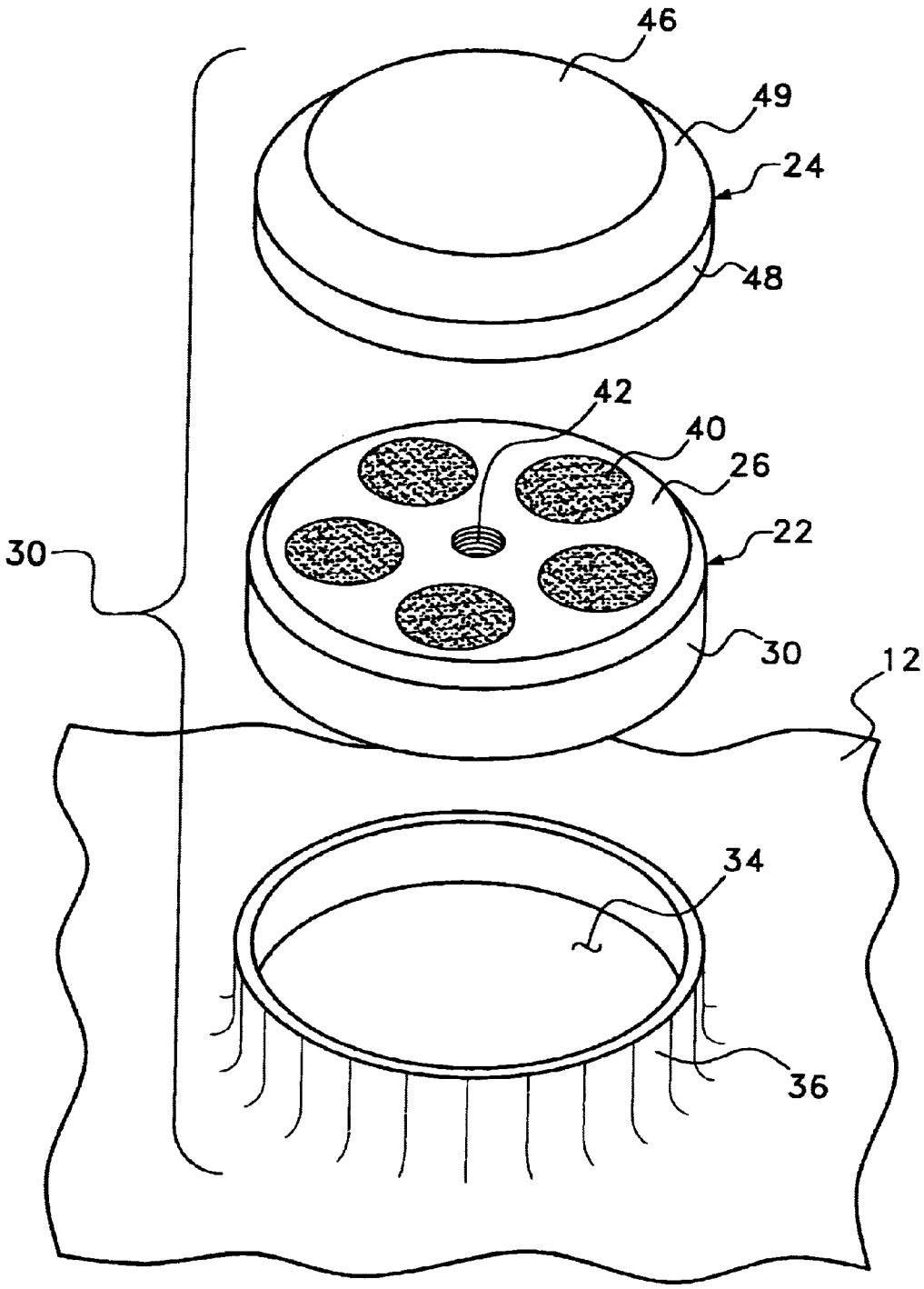
FIG. 2 is an exploded perspective view of the venting port assembly section of the container system shown in FIG. 1.

Referring to FIG. 2, it can be seen that the venting port assembly 20 is comprised of two interconnecting subassemblies. The first subassembly is the filter subassembly 22. The second subassembly is the protective cover subassembly 24 that covers the filter subassembly 22. The protective cover subassembly 24 prevents external objects from inadvertently contacting the filter subassembly 22 and prevents dust and other air borne contaminants from settling on the filter subassembly 22. The overall venting port assembly 20 enables gas to flow in and out of the container 10 (FIG. 1)

so that there is no pressure differential between the inside of the container and surrounding ambient pressure.

Figure 3:
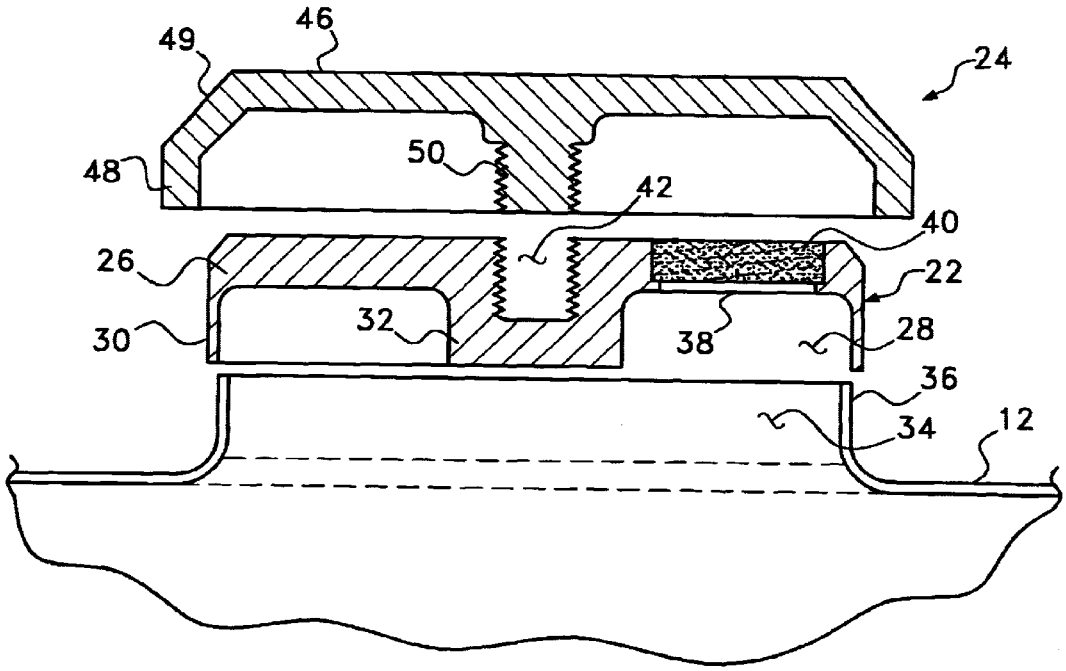
FIG. 3 is a cross-sectional view of the venting port assembly shown in FIG. 2.

Referring to FIG. 3 in conjunction with FIG. 2, it can be seen that the filter subassembly 22 includes a disk-shaped support platform 26. The disk-shaped support platform 26 is preferably made of the same type of stainless steel as is the lid 12 of the container. An annular groove 28 (FIG. 3) is machined on the bottom surface of the support platform 26. The existence of the groove 28 creates a peripheral lip 30 (FIG. 3) that extends around the perimeter of the support platform 26 and a hub 32 (FIG. 3) in the center of the support platform 26.

An aperture 34 is punched in the lid 12 of the container. The metal surrounding the aperture 34 is then drawn upwardly to create a welding flange 36 around the aperture 34. The welding flange 36 on the container lid 12 is then welded to the peripheral lip 30 of the filter subassembly 22, thereby permanently joining the filter subassembly 22 to the container lid 12. In an alternate embodiment, the peripheral lip of the filter subassembly can have internal threading that engages a threaded neck on the container lid. In such an alternate embodiment, the filter subassembly can be selectively connected and disconnected from the container lid.

A plurality of countersunk holes 38 are symmetrically disposed in the top surface of the support platform 26. Within each of the countersunk holes 38 a filter element 40 is press fit. Each filter element 40 is fabricated from a sintered powder metal. Creating components from sintered powder metal is a known technology where metal powder is compressed into a desired shape in a high pressure press. The compressed powder form is then sintered at a temperature below the melting temperature of the metal used. By regulating the pressures and sintering temperature, metal components can be made with a desired density and degree of porosity.

In the present invention, each of the filter elements 40 is preferably made of sintered powdered stainless steel. In this manner, the filter elements 40 have the same coefficients of thermal expansion as does the remainder of the filter subassembly 22. The filter elements 40 are manufactured to be porous, and thus air permeable. Preferably, the filter elements 40 have an effective pore size of no larger than five microns. At this level of porosity, air will slowly permeate each filter element 40. However, liquid at ambient pressure will not flow through the filter elements and solid contaminants will not pass through the filter elements. Accordingly, the filter elements 40 enable air to flow through its structure, yet prevent liquid and solids from passing.

Since the filter elements 40 themselves are made from sintered stainless steel, the filter elements 40 will not be damaged within an autoclave. As such, the filter subassembly 22 can be sterilized with the remainder of the container lid 12 in an industrial autoclave. Furthermore, since the filter elements 40 are press fit into the countersunk holes 38 on the support platform 26, the filter elements 40 can be periodically removed and replaced as required by conditions.

In the center of the top surface of the support platform 26 is a threaded bore 42. The threaded bore 42 extends down into the hub 32 in the center of the annular groove 28. The threaded bore 42 is used to interconnect the protective cover subassembly 24 to the filter subassembly 22.

Still referring to FIG. 3 in conjunction with FIG. 2, it can be seen that the protective cover subassembly 24 has an inverted bowl shape. The top surface 46 of the protective cover subassembly 24 is flat and lay in the horizontal. The protective cover subassembly 24 also contains a peripheral wall 48 that extends in the vertical, wherein a beveled section 49 joins the peripheral wall 48 to the flat top surface 46.

The peripheral wall 48 defines an inner diameter, which is slightly larger than the outside diameter of the filter subassembly 22. A threaded bolt 50 (FIG. 3) extends downwardly from the center of the protective cover subassembly 24. The threaded bolt 50 is sized to engage the threaded bore 42 on the top of the filter subassembly 22.

Figure 4:
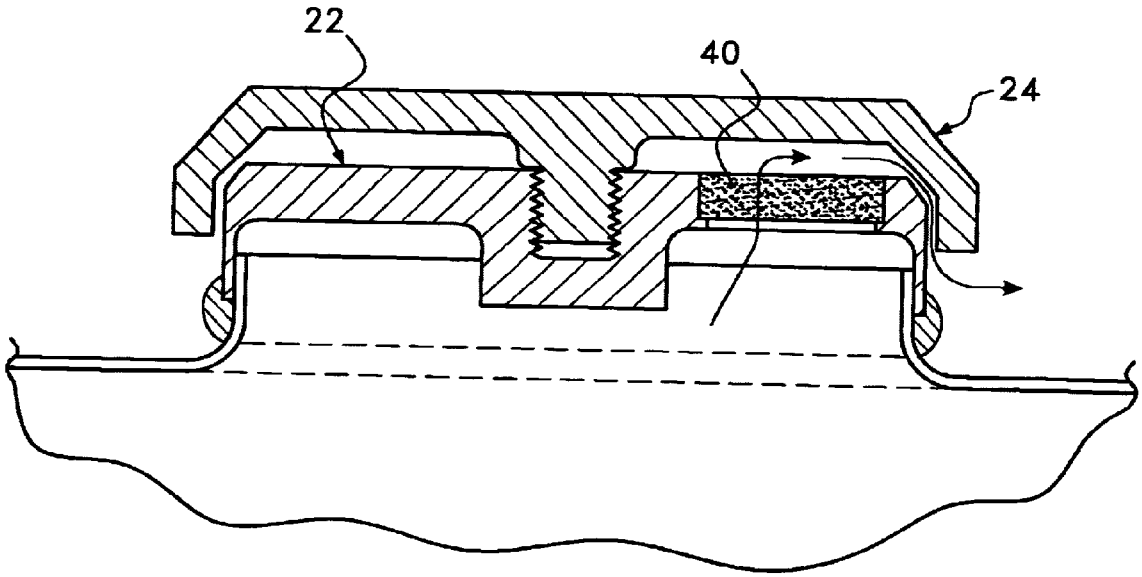
FIG. 4 is a cross-sectional view of the venting port assembly shown in FIG. 2 shown in an assembled condition.

Referring now to FIG. 4, it can be seen that when the protective cover subassembly 24 is connected to the filter subassembly 22, the protective cover subassembly 24 protects the below lying filter elements 40 from inadvertent contact and from settling airborne contaminants. Yet, the protective cover subassembly 24 enables air to pass into and out of the filter elements 40. The protective cover subassembly 24 can be removed so that the filter elements 40 can be accessed.

The protective cover subassembly 24, filter subassembly 22 and lid are all made of stainless steel. Accordingly, to sanitize the assembly, the protective cover subassembly 24 is removed and all pieces are placed into an industrial autoclave. The addition of the venting port assembly therefore requires no more sanitary processing than does a standard unvented container lid.

It will be understood that the various figures described above illustrate only one preferred embodiment of the present invention. A person skilled in the art can therefore make numerous alterations and modifications to the shown embodiment utilizing functionally equivalent components to those shown and described. For example, the shape of the filter subassembly and the cover subassembly can be altered. The number of filter elements in the filter subassembly can be altered. All such modifications are intended to be included within the scope of the present invention as defined by the appended claims.

What is claimed is:

1. A vented assembly for covering the an opening of a container, said assembly containing:

a lid structure sized to cover an opening on the container; wherein said lid structure defines a venting port;

a support platform obstructing said venting port, wherein said support platform contains a central threaded bore and a plurality of holes symmetrically disposed around said central threaded bore;

a porous metal filter disposed within each of said holes in said support platform;

a protective cover having a threaded section that engages said threaded bore of said support platform, wherein said covers extends over each said porous metal filter when attached to said support platform.

2. The assembly according to claim 1, wherein said porous metal filter is a sintered powder metal.

3. The assembly according to claim 1, wherein said lid structure, said support platform and each said porous metal filter are made of the same metal.

4. The assembly according to claim 1, wherein said support platform is welded to said lid structure over said venting port.

5. The assembly according to claim 1, wherein each said porous metal filter is press fit into one of said holes on said support platform.

* * * * *